US006250351B1

(12) United States Patent
Langston et al.

(10) Patent No.: US 6,250,351 B1
(45) Date of Patent: Jun. 26, 2001

(54) BASKET FORM APPARATUS AND METHOD OF USE

(76) Inventors: Diane V. Langston; James S. Langston, both of 5496 Davis La., Spring Hope, NC (US) 27882

( * ) Notice: Subject to any disclaimer, the term of this patent is extended or adjusted under 35 U.S.C. 154(b) by 0 days.

(21) Appl. No.: 09/294,068

(22) Filed: Apr. 19, 1999

Related U.S. Application Data

(60) Provisional application No. 60/080,773, filed on Apr. 6, 1998.

(51) Int. Cl.[7] ..... B27H 3/00
(52) U.S. Cl. ..... 147/48
(58) Field of Search ..... 147/48

(56) References Cited

U.S. PATENT DOCUMENTS

| | | | | |
|---|---|---|---|---|
| 16,953 | * | 3/1857 | Ellis | 147/48 |
| 35,265 | * | 5/1862 | Shuler | 147/48 |
| 184,237 | * | 11/1876 | Gensch | 147/48 |
| 275,349 | * | 4/1883 | Billings | 147/48 |
| 1,116,820 | * | 11/1914 | Huke | 147/48 |
| 1,243,082 | * | 10/1917 | Lloyd | 147/48 |
| 1,595,349 | * | 8/1926 | McKane | 147/48 |
| 1,724,293 | * | 8/1929 | Lawrence | 147/48 |
| 3,563,292 | * | 2/1971 | Gordon | 147/48 |

* cited by examiner

*Primary Examiner*—Allen Ortiz
*Assistant Examiner*—William Hong
(74) *Attorney, Agent, or Firm*—Mills Law Firm PLLC

(57) ABSTRACT

A method of constructing an interwoven basket using a collapsible basket form apparatus is disclosed. The present invention permits the construction of an interwoven basket including a solid bottom surface and upwardly converging woven side walls that define a top opening which is relatively smaller than the largest diameter of the basket. The present collapsible basket form apparatus permits construction of a basket from which a unitary basket form of the same shape could not otherwise be removed upon completion of the basket. The present basket form apparatus is adaptable to construction of baskets of many different sizes and shapes by the use of interchangeable rib components which function to define the basket contours.

8 Claims, 3 Drawing Sheets

BASKET FORM APPARATUS AND METHOD OF USE

CROSS-REFERENCE TO RELATED APPLICATION

This application claims the benefit under 35 U.S.C. 119(e) of United States Provisional Application No. 60/080,773 filed Apr. 6, 1998, by Diane V. Langston and James S. Langston for Basket Form Apparatus.

BACKGROUND OF INVENTION

1. Field of Invention

This invention relates generally to basket weaving and, more particularly, to a method of manufacturing interwoven baskets on a collapsible form apparatus.

Basket weaving forms that permit a basket weaver to accurately construct an interwoven basket are well known to those skilled in the art. For example, such form devices for constructing baskets are disclosed in U.S. Pat. No. 16,953 to Ellis, U.S. Pat. No. 1,116,820 to Huke, U.S. Pat. No. 1,595,349 to McKane and U.S. Pat. No. 1,243,082 to Lloyd. Such devices typically employ a solid wood form having a plurality of component parts or an articulating frame whereon the weaver interweaves strips of natural or synthetic materials. Upon completion of the basket, the form may be disassembled or collapsed and removed from the basket assuming it is provided with a large enough top opening to permit removal of the form members.

However, since such prior art basket forms do not address the problem of constructing a basket having upwardly converging side walls or outwardly curved side walls resulting in a basket having a significantly larger diameter body than the top opening, the present invention has been developed to resolve this problem and other shortcomings of the prior art.

2. Description of Related Prior Art

U.S. Pat. No. 16,953 to Joel A. H. Ellis discloses a form or mold in which wooden slats are formed into baskets. This device is constructed of a plurality of generally cylindrical wooden blocks whereon the wooden slats are applied and secured by bending a wooden hoop about the slats. Thereafter, the wooden slats are interconnected by a wire to form a basket having an open top of a larger diameter than the bottom of the basket.

U.S. Pat. No. 1,116,820 to William Huke discloses a basket frame including a solid bottom plate of a round, oval, square, oblong or other suitable shape to which a plurality of radially disposed arms are attached at one end thereof in pivoting relation. An opposite end of each arm includes an articulating joint which permits the arms to be expanded during the weaving process to a desired diameter and shape. However, this device will not permit the construction of a basket having a body diameter larger than its top opening.

U.S. Pat. No. 1,595,349 to George N. McKane discloses a form for weaving baskets which may be removed from the finished work in sections to provide for the manufacture of baskets having inturned, overhanging sides. However, this device is limited to the construction of cylindrical baskets and does not allow the construction of a basket with a significantly larger body diameter than its top opening.

U.S. Pat. No. 1,243,082 to Marshall B. Lloyd discloses a method of producing woven reed articles which consists in providing a skeleton frame having spaced-apart, connected members presenting relatively small contacting surfaces to the fabric and weaving the reed fabric in a manner convenient for the weaving operation and independent of the frame and, thereafter, applying the reed fabric to and securing it upon the frame instead of weaving the fabric and shaping upon the frame during the weaving operation.

U.S. Pat. No. 1,724,293 to William J. Lawrence discloses a core for use in manufacture of wood and reed baskets having a continuous surface and a plurality of continuous guides extending lengthwise of its outer surface adapted to permit accurate placement and lining up of the upright reeds used in the construction of a basket by blind workers. This device also provides other tactile reference points on the core to allow construction by a blind basket weaver.

U.S. Pat. No. 35,265 to J. D. and J. T. Shuler discloses an improved means for manufacturing baskets. This device consists in use of a generally square block provided with guides, cords and gauge measures or marks over which the basket is formed. The size of the basket constructed may vary by reference to the gauge marks on the form. However, this devise is limited to the construction of generally square or rectangular baskets having open top and parallel side walls.

U.S. Pat. No. 184,237 to George Gensch discloses an apparatus and method of constructing rattan baskets wherein a plurality of shaping blocks or cores are stacked onto a handle having a threaded rod projecting therefrom. The rod is inserted through central apertures in the shaping blocks to provide a form having substantially the shape and size of the interior of the basket to be made. Thereafter, the basket is woven about the form, which is then removed through the top opening of the basket after completion.

Finally, U.S. Pat. No. 3,563,292 to Michael Gordon et al. discloses a method for manufacture of interwoven wicker basket, plastic strip basket, handbag or luggage which involves interweaving the wicker or plastic strips to form a body and to form a cover for the body of the basket and then anchoring by means of a tool the protruding ends of the strips of the body and of the cover to channel the shaped rails which rest on removable supports in the body forming a box-shaped body and cover.

SUMMARY OF THE INVENTION

After study of the above problem, the present invention has been developed to provide a basket form apparatus and a method of constructing a basket thereon such basket having a solid bottom surface and upwardly converging side walls that define a top opening in the basket which is significantly smaller than the body diameter of the basket. This is accomplished by the use of a collapsible basket form apparatus which could not otherwise be removed from the top of the basket upon completion of the basket.

The present basket form apparatus may be adapted to permit the construction of interwoven baskets having numerous different shapes and cross-sectional profiles. In addition, the present basket form apparatus permits accurate construction of an interwoven basket using both natural and synthetic materials.

In view of the above, it is an object of the present invention to provide a basket form apparatus which can be utilized to construct a basket having a top opening which is relatively smaller in diameter in comparison to the size of the body portion of the basket.

Another object of the present invention is to provide a basket form apparatus which can be used to construct such a basket and thereafter completely disassembled and removed from the interior of the basket through a top opening thereof.

Another object of the present invention is to provide a basket form apparatus which is particularly useful in construction of interwoven baskets having a solid bottom surface whereon the present form apparatus is temporarily attached during the basket construction process.

Another object of the present invention is to provide a basket form apparatus which can be adapted to construct baskets having numerous different shapes and cross-sectional profiles.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
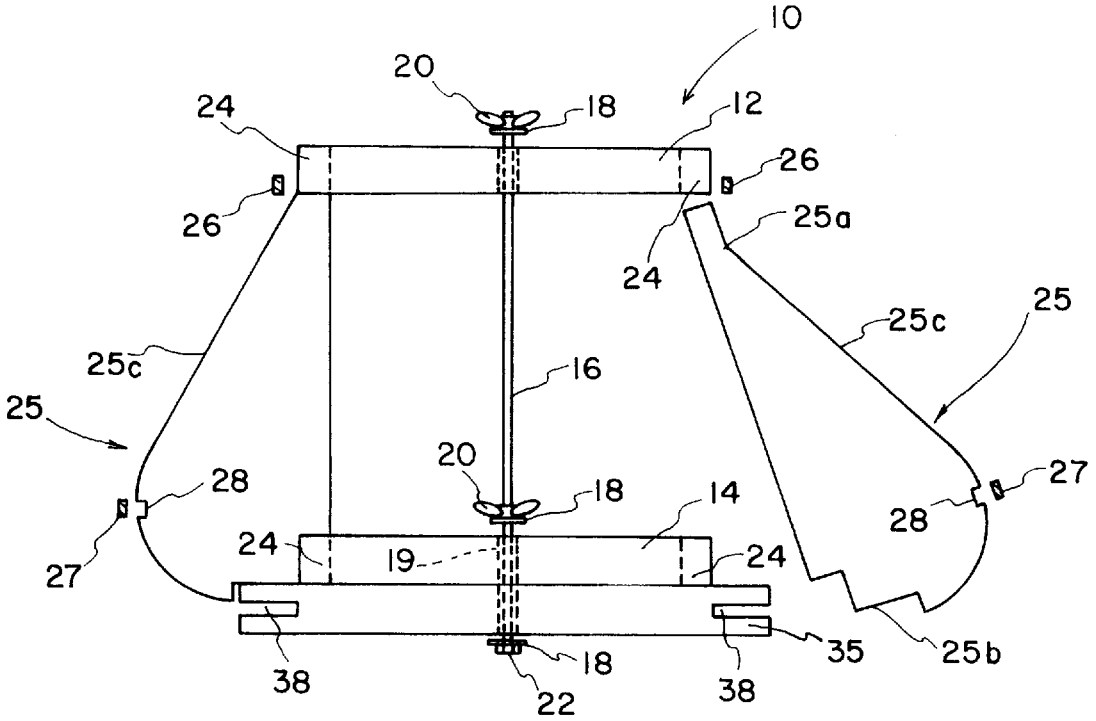
FIG. 1 is a side elevational view of the basket form apparatus of the present invention showing the installation of a rib member between the top plate and the base plate.

With reference to the drawings there is shown therein a basket form apparatus in accordance with the present invention, indicated generally at 10 and illustrated in FIG. 1. In the embodiment shown in FIG. 1 the basket form apparatus 10 is designed for use with a basket of the type having a solid bottom plate 35 made of wood or other suitable material.

However, it will be understood that the basket form apparatus 10 of the present invention can be adapted to other baskets of a similar design and construction. Thus, the embodiment shown is intended to be illustrative of the present invention and not to be considered to be restrictive in any sense.

The basket form apparatus 10 includes a top plate 12 and a base plate 14 which are interconnected by a length of threaded rod 16 that is provided with a plurality of adjustable fasteners such as washers 18, wing nuts 20, and hex nuts 22. The above described fasteners function to secure the basket form apparatus 10 to the bottom 35 of the basket to permit rapid and accurate construction of the basket as shown in FIG. 1.

Figure 2:
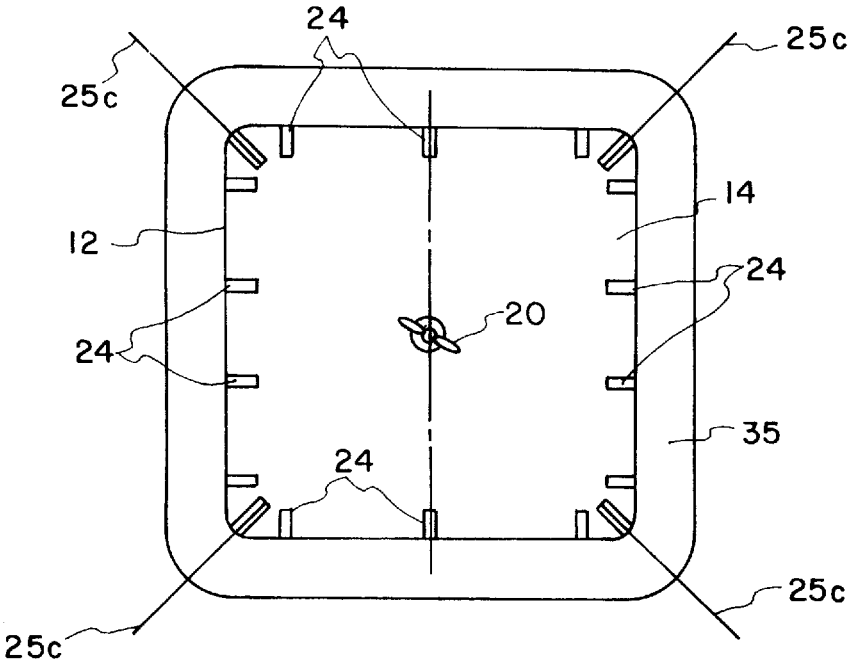
FIG. 2 is a plan view of the basket form apparatus showing the corner rib members installed therein.

The top plate 12 and the base plate 14 are fabricated from wood or other suitable material and each include a plurality of opposed slots 24 formed in the inwardly facing surfaces thereof as more clearly shown in FIG. 2.

Figure 5:
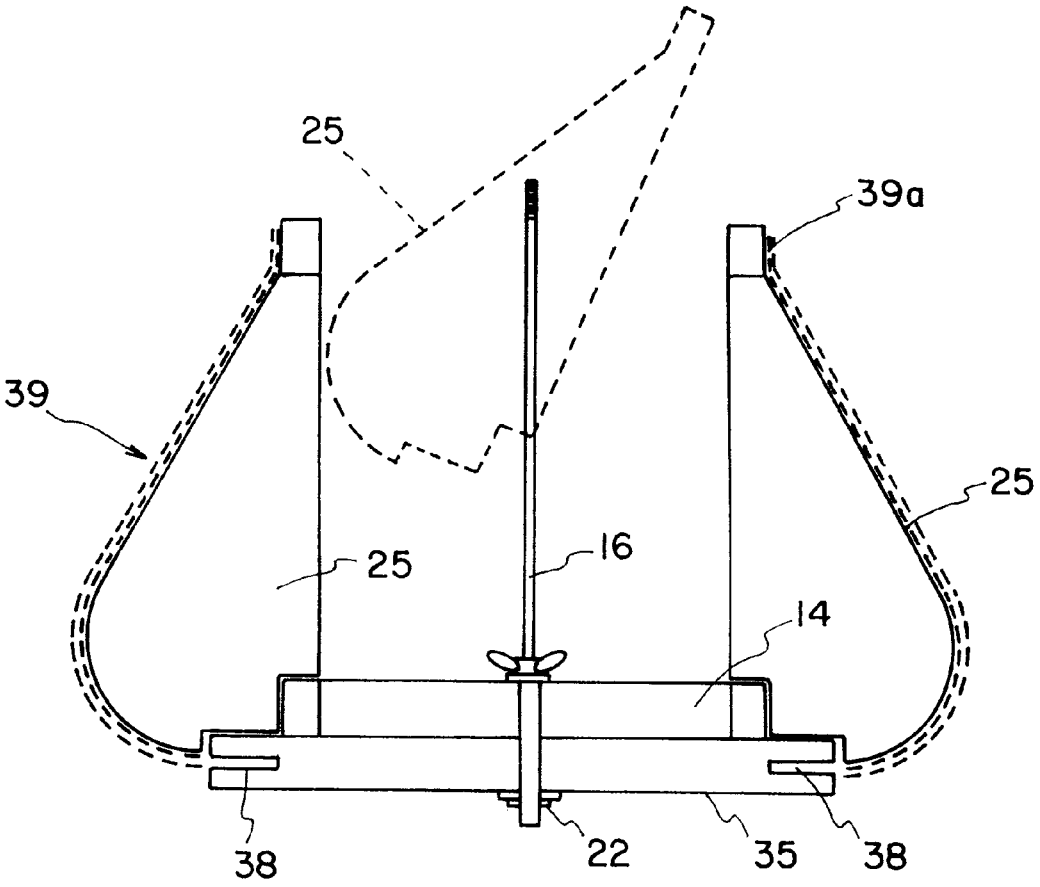
FIG. 5 is a sectional view taken along lines 5—5 of FIG. 3 showing the basket form apparatus being disassembled.

Slots 24 are adapted to receive a plurality of rib members 25 that are configured to define the contours of the basket 39 which will be constructed thereon as most clearly shown in FIG. 5.

In the preferred embodiment, the rib members 25 are fabricated from wood or other suitable material and include an upper tab member 25*a* and lower tab member 25*b*. The respective tabs 25*a* and 25*b* are configured and dimensioned for insertion into the slots 24 formed in the inwardly facing surfaces of top plate 12 and base plate 14 as best seen in FIGS. 1 and 2.

It will be appreciated by those skilled in the art that a plurality of rib members 25 totaling eighteen each for this embodiment and having a substantially similar contour are required to complete the basket form apparatus 10 whereon the basket, indicated generally at 39 will be constructed.

In an assembly procedure of the present invention the top plate 12 and the base plate 14 are provided with a center hole 19 drilled through the respective centers thereof. The threaded rod 16 together with the attaching hardware i.e. washers 18 and wing nuts 20 is inserted through and loosely penetrates each center hole 19 in the top plate 12 and the base plate 14 and thereafter is inserted through a coaxial hole in the bottom 35 of the basket.

Next, the base plate 14 is positioned in symmetrical alignment with the bottom 35 of the basket and secured thereto by advancing the wing nut 20 and the hex nut 22 into contact as shown in FIG. 1.

Thereafter, the comer rib members 25*c* are inserted into their respective positions as shown in FIG. 2 and the top plate 12 is installed thereon and secured by advancing the uppermost wing nut 20 to clamp this subassembly together.

Figure 3:
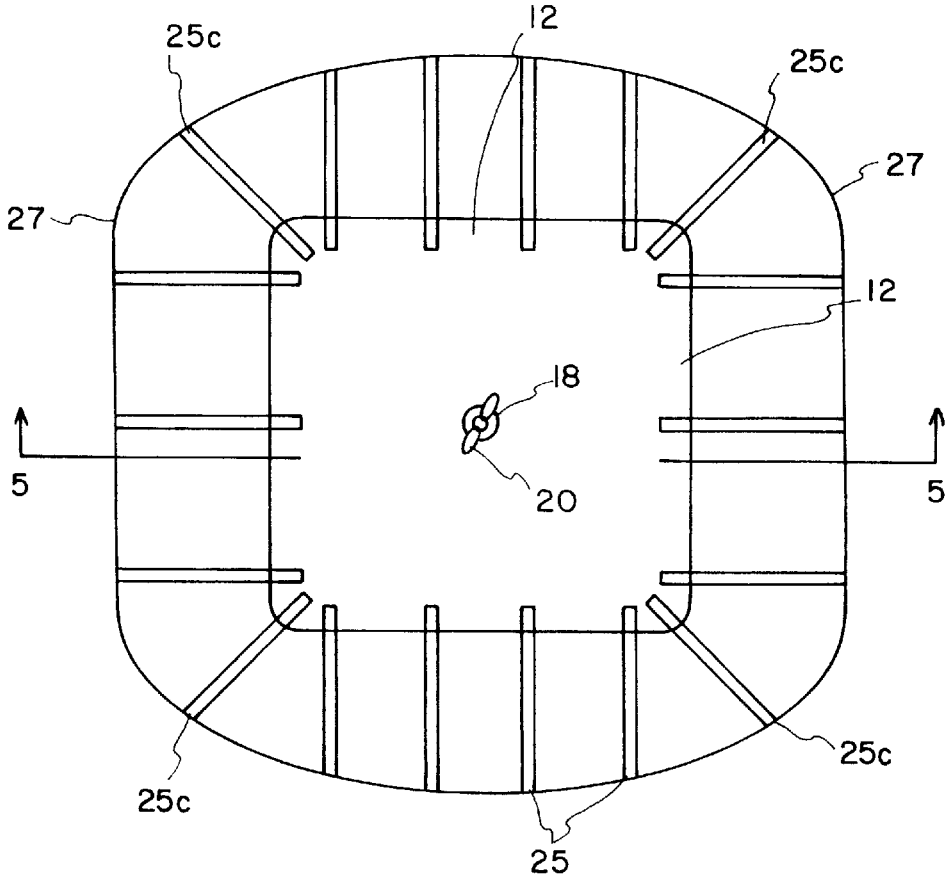
FIG. 3 is a plan view of the basket form apparatus showing all of the rib members installed and retained in position by an elastic band.

Next, a pair of elastic bands 26 and 27 are positioned about the periphery of the top plate 12 and about the lower portion of the rib members 25 respectively within notches 28 to assist in securing the remaining rib members 25 in position as they are inserted into the remaining slots 24 in the top plate 12 and the base plate 14 as shown in FIG. 3.

This is accomplished by holding each rib member 25 in the position shown in FIG. 1 and initially inserting the upper tab 25*a* within the elastic band 26 and into a slot 24 and, thereafter, pivoting the rib member 25 to engage the lower tab 25*b* within the appropriate slot 24 in the base plate 14 and thereafter adjusting the elastic band 27 to engage each respective notch 28.

After all of the rib members 25 have been installed to the position shown in FIG. 3, the upper wing nut 20 is tightened down against the washer 18 on the upper surface of the top plate 12 to hold the form apparatus 10 together.

Thereafter, an interwoven basket 39 may be constructed by initially inserting proximal ends of the material strips (not shown) to be used in the construction of the basket 39 into the horizontally extending slot 38 formed along the peripheral edge of the bottom 35 of the basket as best shown in FIG. 1. The material strips (not shown) must be sufficiently flexible to be wrapped around and to closely conform to the outwardly projecting profile of the rib members 25 extending to an upper edge 39*a* of the completed basket 39.

Once the vertically disposed strips are secured in position, construction proceeds by interweaving a plurality of horizontally disposed material strips in a known manner to the height shown in FIG. 5.

Since such interweaving techniques are well known to those skilled in the art, further detailed discussion of the same is not deemed necessary.

Figure 4:
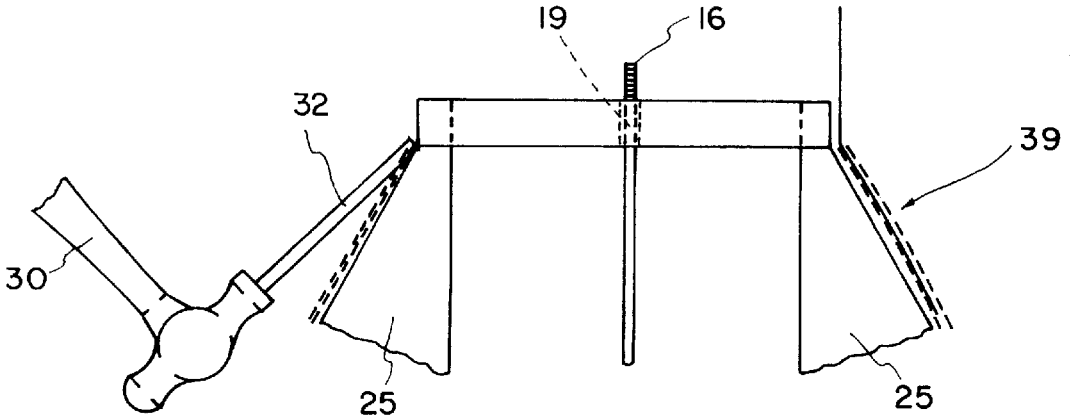
FIG. 4 is a partial side elevational view of the basket form apparatus showing the top plate being removed.

After the weaving operation has been completed to the vertical height of the top plate 12, the two elastic bands 26 and 27 are cut and the upper wing nut 20 is loosened such that the top plate 12 can be removed as shown in FIG. 4. It may be necessary to utilize a hammer 30 to strike a dowel pin 32 or other suitable tool to separate the top plate 12 from the finished basket 39.

Next, the user may reach down into the top opening of the basket 39 and remove the ribs 25 from the form apparatus 10 as shown in FIG. 5.

Thereafter, the bottom nut 22 is loosened and removed from the bottom 35 which is now firmly attached to the basket as at slot 38, and the rod 16 together with the base plate 14 may be removed from the basket 39 through the top opening thereof.

From the above it can be seen that the present invention provides a basket form apparatus and method of using the same which permits the construction of a basket having a solid bottom surface and upwardly converging side walls that define a top opening which is relatively smaller than the largest diameter of the basket. This is accomplished by the use of a collapsible form apparatus which could otherwise not be removed from the top opening upon completion of the basket.

The basket form apparatus of the present invention permits the rapid and accurate assembly of an interwoven basket using both traditional and synthetic material.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A method of constructing an interwoven basket of the type having a solid bottom surface and having a plurality of upwardly converging side walls defining a basket with a top opening having a diameter smaller than the cross-sectional diameter of said basket, said method comprising the steps of:

providing a basket form apparatus including a base plate and a top plate interconnected by a threaded rod, said base plate and top plate including a plurality of vertically opposed slots formed at regular intervals about the peripheral edges thereof;

fabricating a plurality of removable rib members adapted for installation intermediate said top plate and said base plate within said slots;

attaching said base plate to said solid bottom of said basket using said threaded rod and attaching hardware;

inserting a group of four of said ribs at comer slots of said top plate and said base plate;

applying an elastic band about the periphery of said top plate;

attaching a second elastic band about the lower portion of said rib members to secure the same in position within said slots;

clamping said top plate, said ribs, and said base plate together by the use of said attaching hardware on said threaded rod;

installing the remainder of said rib members within said slots and said elastic bands to complete the assembly of said form apparatus;

constructing said basket by securing a plurality of interwoven strips to said solid bottom and interweaving said strips about said form apparatus; and disassembling said form apparatus upon completion of said basket.

2. The method of claim 1 wherein the step of fabricating further includes the steps of:

laying out a plurality of said rib members to produce a basket of a desired shape;

forming said plurality of rib members each having an identical profile to produce a matched set thereof; and repeating the steps of laying out and forming to produce any number of matched sets of said rib members for construction of baskets of different shapes.

3. The method of claim 2 wherein the step of forming is carried out by woodworking machinery.

4. The method of claim 2 wherein the step of forming is carried out by injection molding.

5. The method of claim 1 wherein the step of disassembling further includes the steps of:

loosening said attaching hardware on said threaded rod;

removing said top plate from said basket;

releasing said attaching hardware from said base plate;

withdrawing said rib members from said basket; and taking said base plate and said threaded rod out of said basket.

6. A collapsible basket form apparatus for the construction of interwoven baskets thereon, said basket form apparatus comprising:

a base plate attachable to said bottom member;

a top plate disposed in spaced-apart, vertically opposed relation to said base plate;

a threaded rod disposed in generally perpendicular relation to said base plate and said top plate, said threaded rod including fastening hardware for securing said bottom member, said base plate, and said top plate in vertically stacked relation; and a plurality of rib members and an elastic band member disposed about the peripheral edges of said rib members under tension, said rib members having a predetermined shape and being securable between said base plate and said top plate in symmetrical relation thereto whereby a woven basket closely conforming to the shape of said basket form apparatus is constructed.

7. The basket form apparatus of claim 6 wherein said plurality of rib members are formed in a substantially identical profile as a matched set for producing a woven basket of a desired shape.

8. The basket form apparatus of claim 7 wherein said profile is generally fin-shaped in configuration so as to define a basket having upwardly converging side walls and a relatively small diameter top opening.

* * * * *